US011721311B1

(12) United States Patent
Brown, Sr. et al.

(10) Patent No.: US 11,721,311 B1
(45) Date of Patent: Aug. 8, 2023

(54) GUITAR PICK

(71) Applicant: Terry Michael Brown, Sr., Vincennes, IL (US)

(72) Inventors: Terry Michael Brown, Sr., Vincennes, IN (US); Austin Edward Weinstock, Park Ridge, IL (US)

(73) Assignee: Terry Michael Brown, Sr., Vincennes, IN (US)

( * ) Notice: Subject to any disclaimer, the term of this patent is extended or adjusted under 35 U.S.C. 154(b) by 0 days.

(21) Appl. No.: 17/671,264

(22) Filed: Feb. 14, 2022

(51) Int. Cl.
*G10D 3/173* (2020.01)

(52) U.S. Cl.
CPC ..... *G10D 3/173* (2020.02)

(58) Field of Classification Search
CPC ..... G10D 3/173
See application file for complete search history.

(56) References Cited

U.S. PATENT DOCUMENTS 2,221,234 A * 11/1940 Frasier ..... G10D 3/173 84/322
3,304,826 A * 2/1967 Caron ..... G10D 3/173 84/322
3,312,137 A * 4/1967 Oddo ..... G10D 3/173 84/322
4,226,160 A * 10/1980 Picciochi ..... G10D 3/173 84/322
4,248,128 A * 2/1981 Des Gaines ..... G10D 3/173 84/322
4,398,444 A * 8/1983 Walker ..... G10D 3/173 84/322
4,651,614 A * 3/1987 Cavallo ..... G10D 3/173 84/322
5,253,562 A * 10/1993 Kline ..... G10D 3/173 84/322
5,594,189 A * 1/1997 Latteri ..... G10D 3/173 84/322
D561,237 S * 2/2008 Morris ..... D17/20
D577,379 S * 9/2008 Morris ..... D17/20
7,812,234 B2 * 10/2010 Dybas ..... G10D 3/173 84/322
D632,727 S * 2/2011 Goad ..... D17/20
D632,728 S * 2/2011 Goad ..... D17/20
8,872,008 B2 * 10/2014 Taylor ..... G10D 3/173 84/322
9,190,034 B2 * 11/2015 Fortmuller ..... C23C 28/00
(Continued)

FOREIGN PATENT DOCUMENTS

DE 102011108422 B4 * 12/2020 ..... G10D 3/173
GB 2348536 A * 10/2000 ..... G10D 3/163
GB 2400227 A * 10/2004 ..... G10D 3/163

*Primary Examiner* — Robert W Horn
(74) *Attorney, Agent, or Firm* — Oliff PLC; R. Brian Drozd

(57) ABSTRACT

A guitar pick or plectrum is provided for use with a stringed musical instrument. The guitar pick or plectrum includes a central body and a first picking wing portion peripherally extending from the central body a first longitudinal direction from the central body. The first picking wing portion includes an end portion and multiple layered picking edges each extending in the first longitudinal direction from the end portion and being spaced apart from each other a predefined distance. Each of multiple layered picking edges is configured to pick a same string on a single strum to provide a multiple sounds from a single strum when picking a single string.

17 Claims, 4 Drawing Sheets

(56) References Cited

U.S. PATENT DOCUMENTS

| | | | | |
|---|---|---|---|---|
| 9,837,056 | B1 * | 12/2017 | Davis | G10D 3/173 |
| 9,865,236 | B1 * | 1/2018 | Bradley | G10D 3/173 |
| 9,972,290 | B1 * | 5/2018 | Mason | G10D 3/173 |
| 2008/0110319 | A1 * | 5/2008 | Morris | G10D 3/173 84/320 |
| 2009/0056521 | A1 * | 3/2009 | Goad | G10D 3/173 84/320 |

* cited by examiner

GUITAR PICK

BACKGROUND

Guitar picks can vary tremendously. Finding the right pick is sometimes like finding the perfect guitar—you have to try a lot of them until you find just the right one.

Professional guitarist alike would agree that a plectrum is a very an important choice when considering playability. Some players go so far as to say that a pick has the biggest impact on both tone as well as technique. In particular, striking strings sets the audio signal in motion.

Given the above, guitar picks have historically been a simple device that play a simple function—to have an edge that hits each string once. However, this is a limitation in that if a user wants to hit the same string over and over, the user has to hit the string, stop the momentum of the guitar pick, bring the guitar pick back to the string, hit the string again with the same edge of the pick, and so forth. This process is not a good one if one wants to hit the same string repeatedly.

SUMMARY

Various embodiments provide a guitar pick with layered edges. The layered edges allows for a user to hit the same string multiple time with the guitar pick with a single strum, providing a unique sound.

For example, when playing a six string guitar, the pick will hit the same string twice as one strums down or up, it hits the string twice—giving the guitar a fuller sound as if you were playing a 12 string guitar.

A guitar pick or plectrum is provided for use with a stringed musical instrument. The guitar pick or plectrum includes a central body and a first picking wing portion peripherally extending from the central body a first longitudinal direction from the central body. The first picking wing portion includes an end portion and multiple layered picking edges each extending in the first longitudinal direction from the end portion and being spaced apart from each other a predefined distance. Each of multiple layered picking edges is configured to pick a same string on a single strum to provide a multiple sounds from a single strum when picking a single string.

A method of using a guitar pick or plectrum is provided. The method includes grasping the guitar pick or plectrum at a central body and picking a string with multiple layered picking edges of a first picking wing portion that extends from the central body in a first longitudinal direction from the central body. The multiple layered picking edges each extend in the first longitudinal direction from an end portion of the central body and are spaced apart from each other a predefined distance.

DETAILED DESCRIPTION OF EMBODIMENTS

Figure 1:
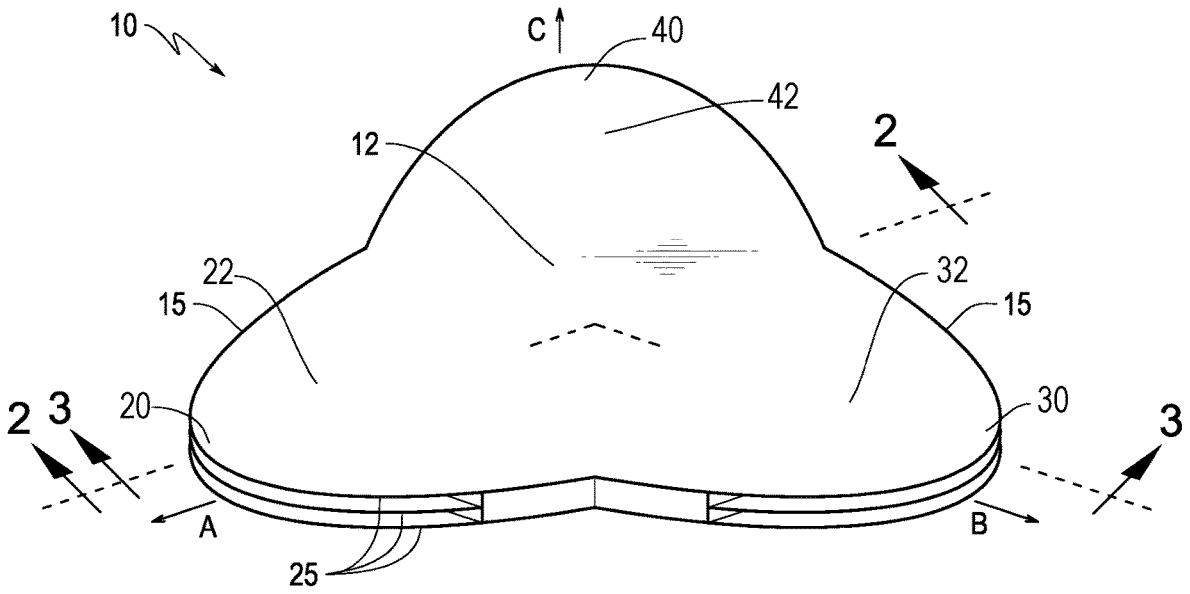
FIG. 1 illustrates a guitar pick with three wing portions according to some embodiments.
Figure 2:
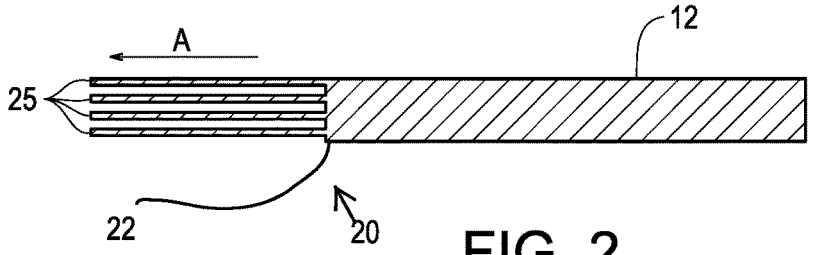
FIG. 2 is a cross section of the guitar pick of FIG. 1 along line 2A-2A according to some embodiments.
Figure 3:
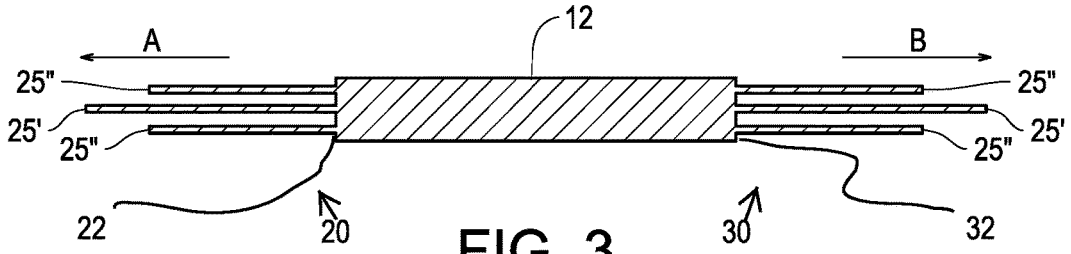
FIG. 3 is a cross section of the guitar pick of FIG. 1 along line 3A-3A according to some embodiments.

In accordance with various embodiments, a guitar pick for use with a stringed musical instrument is discussed herein. Referring to FIGS. 1-3 of the drawings, FIG. 1 illustrates a guitar pick with three wing portions according to some embodiments, FIG. 2 is a cross section of the guitar pick of FIG. 1 along line 2A-2A according to some embodiments, and FIG. 3 is a cross section of the guitar pick of FIG. 1 along line 3A-3A according to some embodiments.

Referring first to FIGS. 1 and 2, there is shown some embodiments of the guitar pick 10 for use with a stringed musical instrument (not shown). The guitar pick 10 has a substantially planar central gripping portion 12 having a periphery 15 and three substantially planar picking wing portions 20, 30, 40. As illustrated in FIG. 1, each of the wing portions 20, 30, 40 peripherally extends one each in a respective different longitudinal direction as indicated respectively by arrows "A", "B", and "C" from the central gripping portion 12. As illustrated, each wing portion includes an end portion 22, 32, 42 respectively. In the embodiment, each respective different longitudinal direction "A", "B", "C" is equally spaced, relative to each adjacent respective different longitudinal direction about the central gripping portion 12. However, it should be understood that each respective different longitudinal direction "A", "B", "C" is may have different spacing.

As stated, the wing portions 20, 30, 40 comprise a first wing portion 20 having a first end portion 22, a second wing portion 30 having a second end portion 32, and a third wing portion 40 having a third end portion 42. Each of the end portions 22, 32, 42 have multiple planar surfaces or multiple layered edges, and as will be described, each may include different designs in order to produce a different tone or sound in application. In particular, the end portion 22 of wing portion 20 may be of design of a traditional guitar pick and the second end portion 32 of wing portion 30 may be of design of an electric guitar pick. For example, the wing portion 20 includes first multiple layered edges 25 spaced apart a first predefined distance, while end portion 32 of wing portion 30 includes second multiple layered edges 35 spaced apart a second predefined distance.

As another example, the wing portion 20 includes first multiple layered edges 25 spaced apart the same predefined distance as the second multiple layered edges 35 of end portion 32 of wing portion 30.

As yet another example, the wing portion 20 includes first multiple layered edges 25 has a first construction (e.g., made of a first material, has a first thickness, etc.) where the second multiple layered edges 35 of end portion 32 of wing portion 30 (made of a second material, has a second thickness, etc.) where one or more elements of the construction for the first wing portion 20 is the same as the second wing portion 30.

The multiple layer edges for each wing portion may be spaced from each other a certain distance, such as anywhere from 0.1 mm to 25.4 mm. In one embodiment, the multiple layer edges for each wing portion may be spaced from each other by 1 mm. In one embodiment, the multiple layer edges for each wing portion may be spaced from each other by 0.75 mm. In one embodiment, the multiple layer edges for each wing portion may be spaced from each other by 0.25 mm. In one embodiment, the multiple layer edges for each wing portion may be spaced from each other by 0.50 mm. In one embodiment, the multiple layer edges for each wing portion may be spaced from each other by 1.25 mm. In one embodiment, the multiple layer edges for each wing portion may be spaced from each other by 1.5 mm. In one embodiment, the multiple layer edges for each wing portion may be spaced from each other by 2 mm.

Additionally, the multiple layer edges for the first, second and third wing portions 20, 30 40 may extend from the first second and third end portions 22, 32, 42, respectively. Each of multiple layer edges for the first, second and third wing portions 20, 30 40 extending from the first second and third end portions 22, 32, 42 may be such that the multiple layer edges can each individually pick a single string in a single strum. For example, each of multiple layer edges for the first, second and third wing portions 20, 30 40 extending from the first second and third end portions 22, 32, 42 may extend a distance between ¼ inch and 1 inch, such as ½ inch, ¼ inch, or 1 inch.

The spacing between each of the multiple layer edges is of a sufficient distance to give a percussive sound during a single stroke in a single direction applying wing portion 30. Further, the peak to peak spacing is preferably uniform. The spacing between the multiple layer edges is of a sufficient distance to give a percussive sound during a single stroke in a single direction applying wing portion 40. Further, the spacing may be uniform between the multiple layer edges. Likewise, the spacing between the multiple layer edges is of a sufficient distance to give a percussive sound during a single stroke in a single direction applying wing portion.

The multiple layer edges described above can be achieved in any suitable fashion. The picks having the multiple wing portions can be made of metal or molded of a plastic material and the multiple layer edges formed during the manufacturing process.

By application of the wing portions 20, 30, 40 of the pick 10, a guitar player can achieve the effect of picking the same note very fast, and achieving a maximum percussive effect as the selected multiple peaks of wing portions 20, 30, 40 respectively strike the string.

Although the description above contains many specificities, these should not be construed as limiting the scope of the invention but as merely providing illustrations of some of the presently preferred embodiments of this invention. For example, while the discussion herein describes the improved guitar pick 10 as including four wing portions 20, 30, 40 and 50, it should be understood that the pick 10 of the present invention can include at least one and up to four wing portions as discussed above.

Referring to FIG. 3 represents an alternate embodiment of the present invention. FIG. 3 is a cross section of the guitar pick of FIG. 1 along line 3A-3A according to some embodiments As shown, there may be any number of the multiple layered edges 25 to be only three layered edges 25', 25". For example, there may be three layered edges 25', 25" on each of the wing portions. Alternatively there may be three layered edges 25', 25" on one wing portion, four layered edges 25 on another wing portion, and only two layered edges 25 on yet another wing portion or any combination thereof. In this regard, there may be the same number of layered edges 25 for each wing portion or different numbers of layered edges 25 for wing portion.

The spacing between the layered edges 25 for each wing portions may be the same number for each wing portion or may be different for each of the wing portions or any combination thereof. For example, as shown in FIG. 3, the spacing between the middle edge 25' and 25" are different for wing portion 20 as compared with the spacing between the middle edge 25' and 25" for wing portion 30.

Also, the distance of extension of the middle edge 25' from the end portion 22, 32, 42 relative to the distance of extension of the end edge 25" from the end portion 22, 32, 42 end edges 25" is greater so that the middle edge 25' extends out longer than each of the end edges 25" as shown in FIG. 3. However, as shown in FIG. 2, all of the layered edges may all be equal in length extending from the end portion.

Figure 4A:
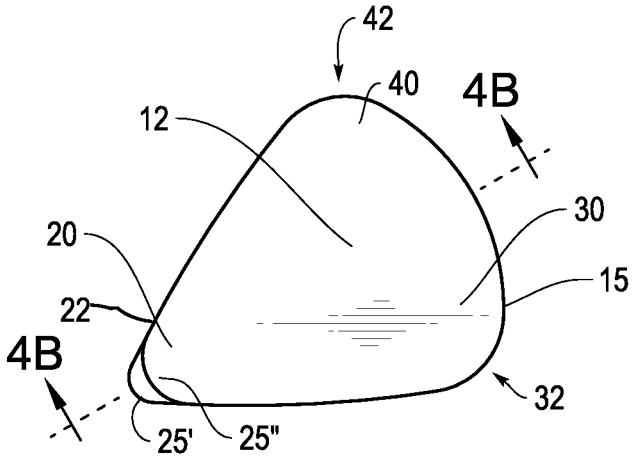
FIG. 4A illustrates a guitar pick with a triangle shape and a single wing portion having layered edges according to some embodiments.

There are other various embodiments of shapes of the guitar pick as shown in FIGS. 4-6. FIG. 4A illustrates a guitar pick with a triangle shape and only having one wing portion having layered edges according to some embodiments. Specifically, only one of the wing portion have layered edges 25 so that the other wing portions are a single pick with a single edge layer. The guitar pick of FIG. 4A includes one or more embodiments discussed above.

Figure 4B:
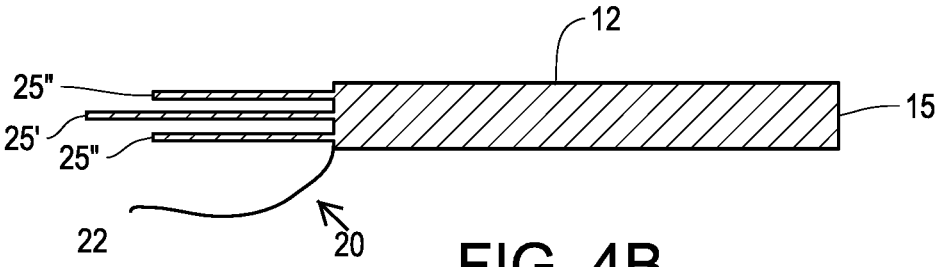
FIG. 4B is a cross section of the guitar pick of FIG. 4A along line 4A-4A according to some embodiments.

FIG. 4B is a cross section of the guitar pick of FIG. 4A along line 4A-4A according to some embodiments. As shown, wing portion 20 is illustrated with three layered edges 25', 25" that extend a distance greater than the distance from the end portion 22 to the periphery 15.

Figure 5A:
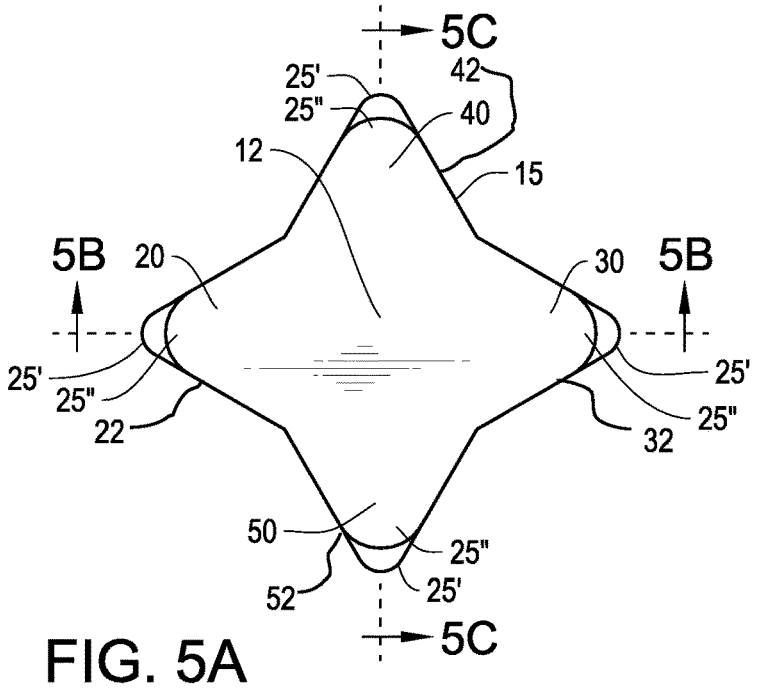
FIG. 5A illustrates a guitar pick with a star shape and four wing portions having layered edges according to some embodiments.

FIG. 5A illustrates a guitar pick with a star shape and four wing portions having layered edges according to some embodiments. The guitar pick of FIG. 5A includes one or more embodiments discussed above.

Figure 5B:
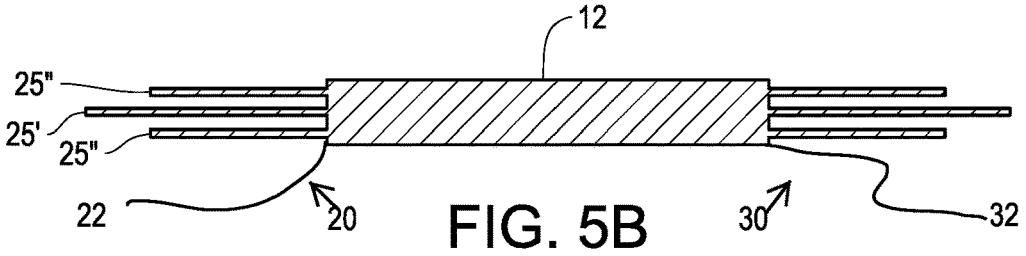
FIG. 5B is a cross section of the guitar pick of FIG. 5A along line 5B-5B according to some embodiments.
Figure 5C:
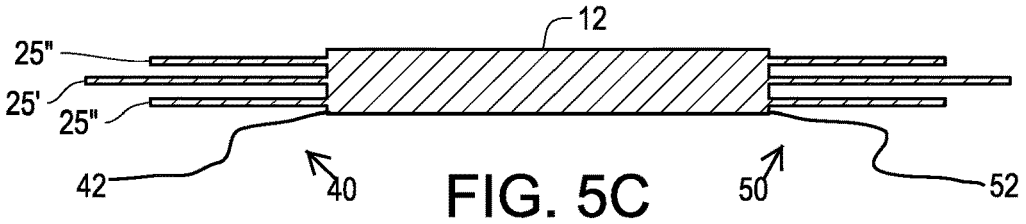
FIG. 5C is a cross section of the guitar pick of FIG. 5A along line 5C-5C according to some embodiments.

The guitar pick of FIG. 5A has multiple layered edges 25, 25', 25" for each of the wing portions 20, 30, 40, 50 in one embodiment. In that embodiment, FIG. 5B shows a cross section of the guitar pick of FIG. 5A along line 5B-5B, and FIG. 5C is a cross section of the guitar pick of FIG. 5A along line 5C-5C. Indeed, three layered edges 25', 25" extend a distance greater than the distance from the end portion 22, 32 for each of the wing portions 20 and 30.

Figure 5D:
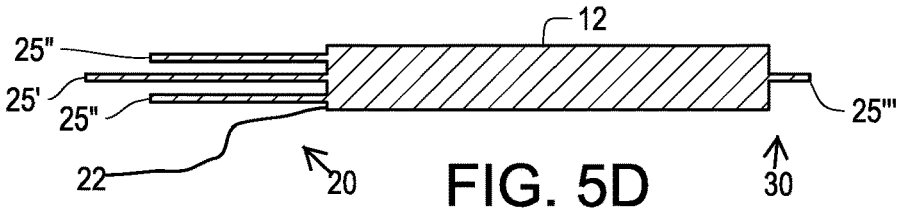
FIG. 5D is a cross section of the guitar pick of FIG. 5A along line 5B-5B according to other embodiments.
Figure 5E:
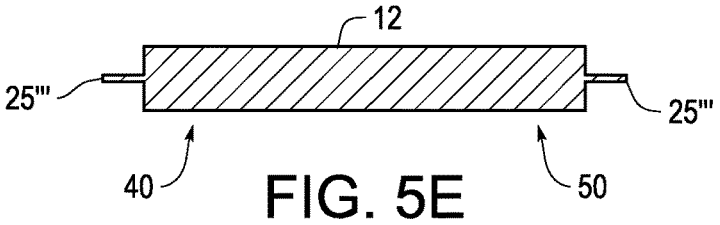
FIG. 5E is a cross section of the guitar pick of FIG. 5A along line 5C-5C according to other embodiments.

In that embodiment, FIGS. 5D and 5E shows a cross section of the guitar pick of FIG. 5A along line 5B-5B and line 5C-5C. respectively, according to other embodiments Indeed, three layered edges 25', 25" extend a distance greater than the distance from one of the end portion 22 the wing portion 20 and only a single edge 25' extend a distance greater than the distance from one of the end portions 32, 42, 52 for each of the wing portions 30, 40 and 50. In this regard, the wing portions 30, 40 and 50 may have a standard single pick edge 25' to play a guitar normally, while one or more of the wing portions may have the three layered edges 25', 25" configuration.

It should be noted that the single edge 25' when a wing portion has only one pick edge extending from the end portion (as opposed to multiple layered edges), as is shown at wing portion 32 of FIG. 5D, and such extension may be a distance shorter than the middle layered edge 25' of wing portion 22.

Figure 6A:
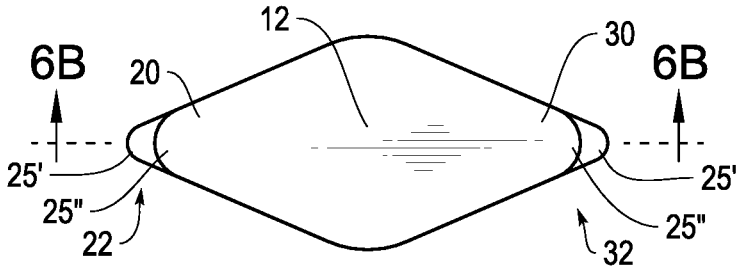
FIG. 6A illustrates a guitar pick with a diamond shape and only two wing portions having layered edges according to some embodiments.
Figure 6B:
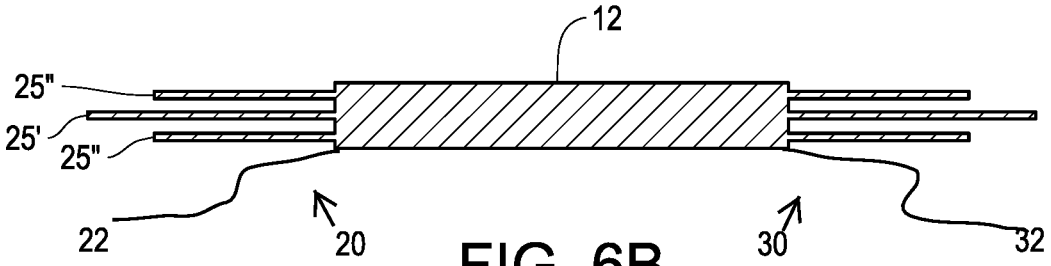
FIG. 6B is a cross section of the guitar pick of FIG. 6A along line 6B-6B according to some embodiments.

FIG. 6A illustrates a guitar pick with a diamond shape and only two wing portions have layered edges according to some embodiments. The guitar pick of FIG. 6A includes one or more embodiments discussed above. FIG. 6B is a cross section of the guitar pick of FIG. 6A along line 6B-6B according to some embodiments.

It should be understood that each wing portion may have each layered edge 25 extending a distance relative to the other layered edges independent from other wing portions or the same as other wing portions.

Figure 6C:
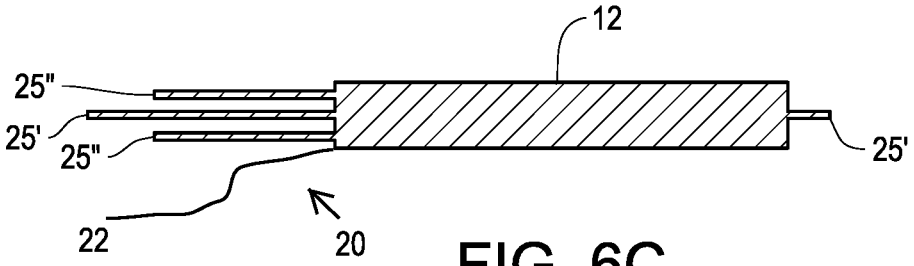
FIG. 6C is a cross section of the guitar pick of FIG. 6A along line 6B-6B according to other embodiments.

FIG. 6C is a cross section of the guitar pick of FIG. 6A along line 6B-6B according to other embodiments. In this embodiment, the layered edge for wing portion 32 is the only edge extending from end portion 32, similar to what is shown and discussed above with regard to FIG. 5D.

It would be obvious to those skilled in the art that modifications may be made to the embodiments described above without departing from the scope of the present invention.

Thus the scope of the invention should be determined by the appended claims in the formal application and their legal equivalents, rather than by the examples given.

What is claimed is:

1. A guitar pick or plectrum is provided for use with a stringed musical instrument, the guitar pick or plectrum comprising a central body extending a first length in a longitudinal direction;

a first picking wing portion peripherally extending a second length from the central body in the longitudinal direction from the central body where the first length is greater than the second length, where the first picking wing portion comprises:

an end portion; and multiple layered picking edges each extending in the first longitudinal direction from the end portion and comprising:

a first picking edge having a first width in a width direction that is orthogonal to the longitudinal direction; and at least two additional picking edges which are each (1) shorter than the first multiple layered picking edge in the first longitudinal direction and (2) have a width in the width direction that is equal to or wider than the first width so that the multiple layered picking edges are configured to pick a same string on a single strum to provide a multiple sounds when picking a single string on the single strum.

2. The guitar pick or plectrum of claim 1, wherein the predefined distance comprises between 0.5 mm and 2 mm.

3. The guitar pick or plectrum of claim 1, wherein the multiple layered picking edges extend a distance of between ½ inch to 1 inch from the end portion.

4. The guitar pick or plectrum of claim 1, wherein each of the multiple layered picking edges are planar surfaces that are only connected together at the end portion.

5. The guitar pick or plectrum of claim 1, wherein each of the multiple layered picking edges are planar surfaces and are parallel to each other.

6. The guitar pick or plectrum of claim 1, wherein each of the multiple layered picking edges are spaced from each other so that air gaps are created by the spacing between the multiple layered picking edges.

7. The guitar pick or plectrum of claim 1, further comprising a second picking wing portion extending in a second longitudinal direction from the central body, wherein the first longitudinal direction is different from the second longitudinal direction, and wherein the second picking wing portion comprises a second end portion; and second multiple layered picking edges each extending in the second longitudinal direction from the end portion and being spaced apart from each other a second predefined distance.

8. The guitar pick or plectrum of claim 7, wherein the first and second predefined distances are equal.

9. The guitar pick or plectrum of claim 7, wherein the first and second predefined distances are different.

10. The guitar pick or plectrum of claim 7, further comprising a third picking wing portion extending in a third longitudinal direction from the central body, wherein the first, second and third longitudinal directions are all different directions, and wherein the third picking wing portion comprises a third end portion; and third multiple layered picking edges each extending in the third longitudinal direction from the end portion and being spaced apart from each other a third predefined distance.

11. A method of using a guitar pick or plectrum, the method comprising:

grasping the guitar pick or plectrum at a central body that extends a first length, wherein a first picking wing portion peripherally extends a second length from the central body in a first longitudinal direction from the central body, where the first length is greater than the second length, picking a string with multiple layered picking edges of the first picking wing portion, wherein the multiple layered picking edges each extend in the first longitudinal direction from an end portion of the central body and comprises:

a first picking edge having a first width in a width direction that is orthogonal to the longitudinal direction; and at least two additional picking edges which are each (1) shorter than the first multiple layered picking edge in the first longitudinal direction and (2) have a width in the width direction that is equal to or wider than the first width so that the multiple layered picking edges are configured to pick a same string on a single strum.

12. The method of claim 11, wherein the predefined distance comprises 0.5 mm and 2 mm.

13. The method of claim 11, wherein the multiple layered picking edges extend a distance of between ½ inch to 1 inch from the end portion.

14. The method of claim 11, wherein each of the multiple layered picking edges are planar surfaces that are only connected together at the end portion.

15. The method of claim 11, wherein each of the multiple layered picking edges are planar surfaces and are parallel to each other.

16. The method of claim 11, wherein each of the multiple layered picking edges are spaced from each other so that air gaps are created by the spacing between the multiple layered picking edges.

17. A guitar pick or plectrum is provided for use with a stringed musical instrument, the guitar pick or plectrum comprising a central body;

a first picking wing portion peripherally extending from the central body a first longitudinal direction from the central body, where the first picking wing portion comprises:

an end portion; and multiple layered picking edges each extending in the first longitudinal direction from the end portion and being spaced apart from each other a predefined distance so that each of multiple layered picking edges is configured to pick a same string on a single strum to provide a multiple sounds from a single strum when picking a single string; and a second picking wing portion extending in a second longitudinal direction from the central body, wherein the first longitudinal direction is different from the second longitudinal direction, and wherein the second picking wing portion comprises a second end portion; and second multiple layered picking edges each extending in the second longitudinal direction from the end portion and being spaced apart from each other a second predefined distance.

* * * * *